US010625903B2

(12) United States Patent
Akutsu et al.

(10) Patent No.: US 10,625,903 B2
(45) Date of Patent: Apr. 21, 2020

(54) METHOD OF FILLING LIQUID CONTENT AND PACKING CONTAINER FILLED WITH LIQUID CONTENT

(71) Applicant: TOYO SEIKAN GROUP HOLDINGS, LTD., Tokyo (JP)

(72) Inventors: Yosuke Akutsu, Yokohama (JP); Toshirou Washizaki, Yokohama (JP); Shinya Iwamoto, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 190 days.

(21) Appl. No.: 15/311,966

(22) PCT Filed: May 1, 2015

(86) PCT No.: PCT/JP2015/063132
§ 371 (c)(1),
(2) Date: Nov. 17, 2016

(87) PCT Pub. No.: WO2015/182336
PCT Pub. Date: Dec. 3, 2015

(65) Prior Publication Data

US 2017/0101217 A1 Apr. 13, 2017

(30) Foreign Application Priority Data

May 27, 2014 (JP) ..... 2014-108663
Mar. 23, 2015 (JP) ..... 2015-059530

(51) Int. Cl.
*B65D 23/02* (2006.01)
*B65B 39/00* (2006.01)
*B65B 3/16* (2006.01)
*B65B 55/22* (2006.01)
(Continued)

(52) U.S. Cl.
CPC ..... *B65D 23/02* (2013.01); *B05D 1/02* (2013.01); *B05D 7/50* (2013.01); *B65B 3/04* (2013.01);
(Continued)

(58) Field of Classification Search
CPC ..... B65D 23/02; B65D 85/72; B65D 1/0215; B65B 3/04; B65B 55/22; B65B 29/00;
(Continued)

(56) References Cited

U.S. PATENT DOCUMENTS 2,284,651 A * 6/1942 Gundlach ..... A23G 9/282 426/249
3,559,700 A 2/1971 Erickson
(Continued)

FOREIGN PATENT DOCUMENTS

BE 485541 A 1/2014
CN 1424973 A 6/2003
(Continued)

OTHER PUBLICATIONS

International Search Report of PCT/JP2015/063132 dated Aug. 4, 2015 [PCT/ISA/210].
(Continued)

*Primary Examiner* — Timothy P. Kelly
(74) *Attorney, Agent, or Firm* — Sughrue Mion, PLLC

(57) ABSTRACT

A method of filling a container (30) with a liquid content (31), by ejecting a multilayer filler that includes a core layer of the fluid content and an outermost layer of a liquid while forming a film of the liquid between the inner wall of the container and the liquid content.

4 Claims, 2 Drawing Sheets

(51) Int. Cl.

| | |
|---|---|
| ***B65B 29/00*** | (2006.01) |
| ***B65B 39/12*** | (2006.01) |
| ***B65B 3/04*** | (2006.01) |
| ***B05D 1/02*** | (2006.01) |
| ***B05D 7/00*** | (2006.01) |
| ***B65D 1/02*** | (2006.01) |
| ***B65D 85/72*** | (2006.01) |

(52) U.S. Cl.
CPC ..... *B65B 3/16* (2013.01); *B65B 29/00* (2013.01); *B65B 39/00* (2013.01); *B65B 39/12* (2013.01); *B65B 55/22* (2013.01); *B65D 1/0215* (2013.01); *B65D 85/72* (2013.01); *B65B 2039/009* (2013.01); *B65B 2220/14* (2013.01)

(58) Field of Classification Search
CPC ..... B65B 39/00; B65B 3/16; B65B 2039/009; B65B 2220/14; B05D 7/50; B05D 1/02
See application file for complete search history.

(56) References Cited

U.S. PATENT DOCUMENTS

| | | | | |
|---|---|---|---|---|
| 9,894,913 | B2 * | 2/2018 | Beuchert | B65B 25/005 |
| 10,150,582 | B2 * | 12/2018 | Yamada | B65B 3/04 |
| 2001/0018936 | A1 | 9/2001 | Weckerle | |
| 2003/0019884 | A1 | 1/2003 | San Martin et al. | |
| 2010/0092621 | A1 | 4/2010 | Akutsu et al. | |
| 2015/0108032 | A1 * | 4/2015 | Akutsu | B65D 23/02 206/524.4 |
| 2017/0361983 | A1 | 12/2017 | Beltman et al. | |

FOREIGN PATENT DOCUMENTS

| | | | |
|---|---|---|---|
| CN | 101107167 | A | 1/2008 |
| CN | 103476586 | A | 12/2013 |
| DE | 10009990 | A1 | 9/2001 |
| EA | 201791430 | A1 | 10/2017 |
| EP | 1992420 | A1 | 11/2008 |
| JP | 49-26877 | Y1 | 7/1974 |
| JP | 50-3951 | U | 1/1975 |
| JP | 52-128444 | U | 9/1977 |
| JP | 2-172904 | A | 7/1990 |
| JP | 5-65174 | A | 3/1993 |
| JP | 2007-223098 | A | 9/2007 |
| JP | 2007-284066 | A | 11/2007 |
| JP | 2008-222291 | A | 9/2008 |
| JP | 2009-214914 | A | 9/2009 |
| JP | 2012-162323 | A | 8/2012 |
| JP | 2013-010541 | A | 1/2013 |
| WO | 2006/091159 | A1 | 8/2006 |
| WO | 2014/010534 | A1 | 1/2014 |

OTHER PUBLICATIONS

Communication dated Apr. 10, 2018 from the European Patent Office in counterpart European application No. 15798760.3.
Communication dated Jun. 6, 2017, from the Japanese Patent Office in counterpart Japanese application No. 2015-201980.
Communication dated Mar. 14, 2018 from the Russian Patent Office in counterpart Russian application No. 201692391/31.
Communication dated Jun. 3, 2019, issued by the European Patent Office in counterpart Euorpean application No. 19158927.4.

* cited by examiner

Fig. 3
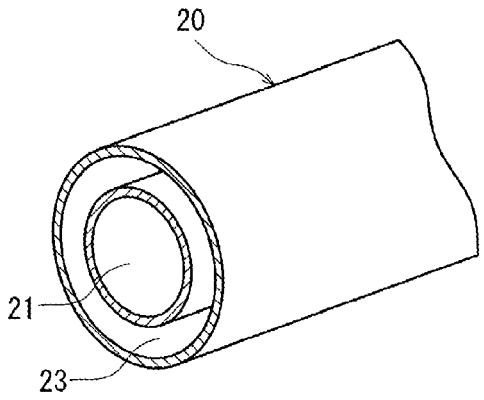
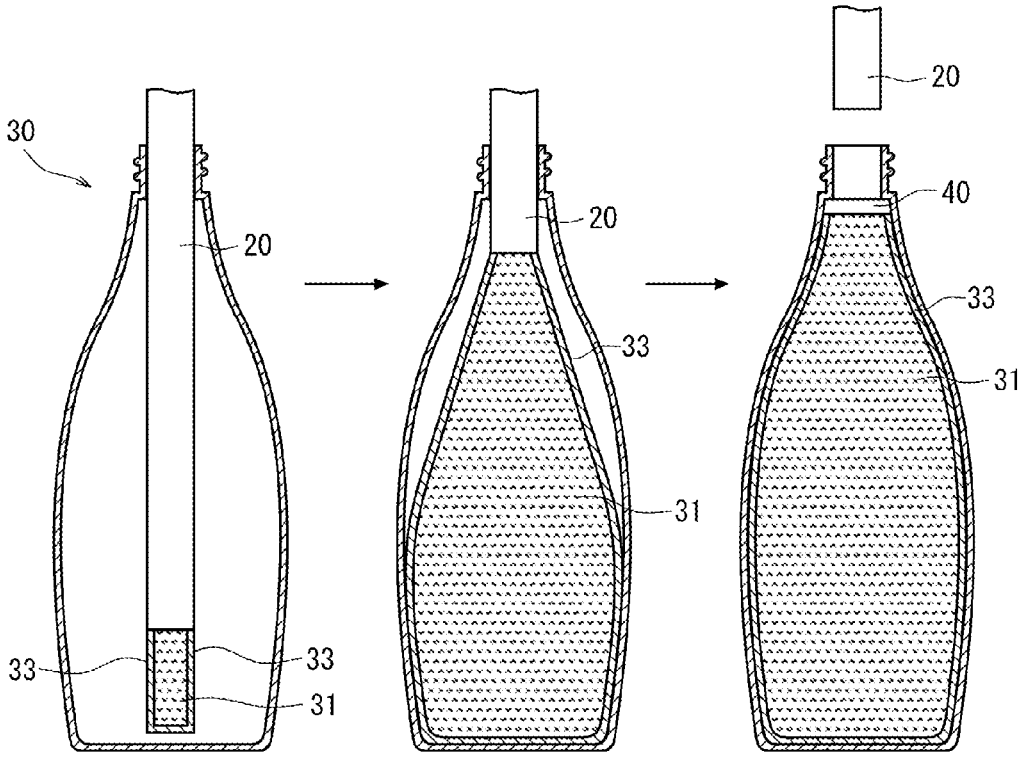
Fig. 4A Fig. 4B Fig. 4C

METHOD OF FILLING LIQUID CONTENT AND PACKING CONTAINER FILLED WITH LIQUID CONTENT

CROSS REFERENCE TO RELATED APPLICATIONS

This application is a National Stage of International Application No. PCT/JP2015/063132, filed May 1, 2015, claiming priority based on Japanese Patent Application Nos. 2014-108663, filed May 27, 2014 and 2015-059530, filed Mar. 23, 2015, the contents of all of which are incorporated herein by reference in their entirety.

TECHNICAL FIELD

This invention relates to a method of filling a container with a liquid content and, specifically, to a method of filling a container with a highly viscous liquid content. The invention, further, relates to a packing container filled with a liquid content.

BACKGROUND ART

Plastic containers are easy to form, can be inexpensively produced, and have, therefore, been widely used in a variety of applications. Specifically, olefin resin containers directly blow-formed in the shape of a bottle and having an inner surface formed by using an olefin resin such as low-density polyethylene, have been favorably used as containers for containing viscous slurry or paste-like liquid contents such as ketchup and the like from such a standpoint that the contents can be easily squeezed out.

Further, the bottles containing highly viscous liquid contents are, in many cases, stored in an inverted state so that the contents can be quickly discharged or can be all used up to its last drop without remaining in the bottles. When the bottles are inverted, therefore, it is desired that the viscous contents do not adhere or remain on the inner wall surfaces of the bottles but fall down quickly.

As a bottle for satisfying the above requirements, for example, a patent document 1 is proposing a bottle of a multilayered structure in which the innermost layer comprises an olefin resin having an MFR (melt flow rate) of not less than 10 g/10 min.

In the above bottle of the multilayered structure, the innermost layer has excellent wettability for the oily contents. Therefore, if the bottle is inverted or is titled, the oily content such as mayonnaise or the like falls down spreading over the surface of the innermost layer and is completely discharged without adhering or staying on the inner wall surface (surface of the innermost layer) of the bottle.

As bottles for containing viscous non-oily contents in which plant fibers are dispersed in water like ketchup, patent documents 2 and 3 are proposing polyolefin resin bottles having an innermost layer that is blended with a saturated or unsaturated aliphatic amide as the lubricant.

The above patent documents 1 to 3 are all concerned to plastic containers having improved slipping property to the contents relying upon the chemical compositions of the thermoplastic resin compositions forming the inner surfaces of the containers, and are achieving slipping properties improved to some extent. Due to limitation on the kinds of the thermoplastic resins and on the additives, however, limitation is also imposed on improving the slipping properties, and striking improvements have not been achieved yet.

In recent years, further, there has been proposed a container having an inner surface that is a liquid-permeable surface, i.e., having a surface that is a liquid-permeable surface on the side that comes in contact with the content (patent document 4). In the above container, a film of a liquid is formed on a portion that comes in contact with the liquid content in the container, the film of the liquid exhibiting very improved slipping property to the liquid content such as ketchup, sauce, mayonnaise or the like.

In the containers of this kind, however, there still remains a problem in regard to how to thinly, uniformly and efficiently form the film of the liquid to improve slipping property to the contents.

A generally employed means comprises, for example, forming a container, spraying a liquid onto a portion of the container to where the content comes in contact to form a film of the liquid thereon and, thereafter, filling up the content. This means, however, necessitates the step of forming the liquid film prior to filling the content causing, therefore, a decrease in the productivity. Further, if it is attempted to uniformly form the liquid film in the container by the above means, it becomes necessary to spray the liquid in unnecessarily large amounts. As a result, liquid reservoirs tend to form in the container causing a large dispersion in the thickness of the liquid film.

The present applicant has is proposed a means of forming a liquid film by mixing a liquid into a resin that forms the inner surface of a container (JP-A-2013-23468. PCT/JP2014/052879). According to this method, there is no need of providing the step of forming the liquid film prior to filling up the content and, therefore, the productivity is satisfactory. The liquid film, however, is formed on the inner surface of the container as the liquid bleeds out from the blend of resin that is forming the inner layer. Therefore, the thickness of the liquid film often becomes considerably small, and it is difficult to reliably control the thickness of the liquid film.

PRIOR ART DOCUMENTS

Patent Documents

Patent document 1: JP-A-2007-284066
Patent document 2: JP-A-2008-222291
Patent document 3: JP-A-2009-214914
Patent document 4: WO2014-010534

OUTLINE OF THE INVENTION

Problems that the Invention is to Solve

It is, therefore, an object of the present invention to provide a method of filling a container with a liquid content, the method being capable of efficiently forming a film of a liquid on the inner surface of the container.

Another object of the present invention is to provide a packing container filled with a liquid content by the above filling method.

Means for Solving the Problems

According to the present invention, there is provided a method of filling a container with a liquid content, comprising:

providing a liquid which is different from the liquid content; and forming a film of the liquid between an inner wall of the container and the liquid content by filling the container with the liquid content of which an outer circumference is at least partly covered with the liquid or with a mixed liquid of the immiscible liquid and the fluid content.

According to the above filling method, it is desired that:
(1) The liquid is a liquid immiscible with the liquid content;
(2) A multilayer filler is ejected, the multilayer filler comprising a core layer of the liquid content and an outermost layer of the liquid or the mixed liquid;
(3) The filling starts in a state where the ejected end of the liquid content is covered with the liquid or with the mixed liquid;
(4) Use is made of a multi-pipe nozzle comprising a center pipe and an annular pipe surrounding the center pipe; and the container is filled with the liquid content by inserting the multi-pipe nozzle into the container, ejecting the liquid content from the center pipe of the multi-pipe nozzle, and ejecting the liquid or the mixed liquid from the annular pipe of the multi-pipe nozzle;
(5) Filling is continued by ejecting the liquid or the mixed liquid and the liquid content while gradually removing the multi-pipe nozzle from the container as the amount of the liquid content filled in the container increases; and
(6) The liquid or the mixed liquid is ejected at a timing earlier than a timing at which the liquid content is ejected from the center pipe.

According to the present invention, further, there is provided a packing container filled with a liquid content, wherein in an unused and erected state, a head space is present in the packing container, and a film of a liquid different from the liquid content is selectively formed in a portion except the head space.

In the packing container, it is desired that:
(7) The liquid is a liquid immiscible with the liquid content; and
(8) The container is in the shape of a bottle or a pouch.

Effects of the Invention

In the filling method of the present invention, the container is filled with a liquid content and, at the same time, a film of a liquid (e.g., liquid for reforming the surface) is formed making it possible to effectively avoid a decrease in the productivity caused by the operation for forming the liquid film.

In the above method, further, the container is filled with the liquid content which is in a state of being wrapped with the liquid film. Therefore, the liquid film is necessarily present between the inner surface of the container and the liquid content filled in the container. As a result, the liquid exhibits improved slipping property to the liquid content maintaining reliability and stability without dispersion.

Further, when the container of the shape of a bottle is filled with the liquid content, the container, usually, forms a space called head space. If the filling method of the present invention is adopted, however, the film of the liquid is selectively formed in a region where the content is present provided the container is in an unused and erected state, and no liquid film is formed in the head space. Namely, in the present invention, the film of the liquid is formed in only the region where it is desired to improve the slipping property to the liquid content. Therefore, the cost is effectively prevented from increasing unnecessarily.

BRIEF DESCRIPTION OF THE DRAWINGS

FIG. 3: a perspective view showing an end portion of a multiple nozzle used for the filling method of the present invention.

FIGS. 4A to 4C: views illustrating the filling method of the present invention.

MODES FOR CARRYING OUT THE INVENTION

<Form of the Packing Container>

Figure 1:
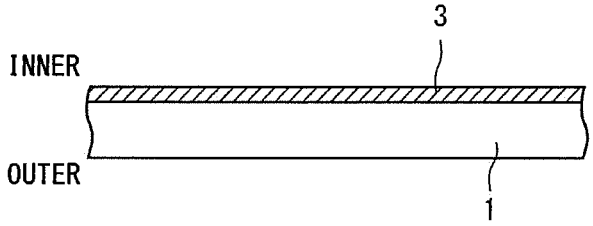
FIG. 1: a partial sectional view showing the state of an inner surface of a packing container formed relying on a filling method of the present invention.

Reference is now made to FIG. 1 which shows the state of an inner surface of a packing container to which the filling method of the present invention is adopted. The container has a film 3 of a liquid formed on the inner surface of a container material 1 to reform the surface thereof. A liquid content is filled up on the liquid film 3. Namely, in the filling method of the present invention, the liquid film 3 is formed and, substantially at the same time, the liquid content is filled up.

The container material 1 has a structure that is capable of stably holding the film 3 of the liquid formed on the inner surface thereof. The container material will be a resin, a glass, a paper or a metal. Of them, it is desired that the container material has a structure of which the inner surface is made of a resin in which the liquid permeates to a suitable degree to improve affinity between the liquid and the container material effectively avoiding the liquid from splitting off.

As the resin, there can be exemplified thermoplastic resins that can be formed into containers, such as polyesters as represented by polyethylene terephthalate, and olefin resins. Specifically, there can be exemplified olefin resins and, in particular, low-density polyethylene, straight chain low-density polyethylene, medium- or high-density polyethylene, polypropylene, poly 1-butene, and poly 4-methyl-1-pentene from such a standpoint that they can be favorably used for forming containers such as directly blow-formed containers for containing viscous liquid contents that require improved slipping property. There can be also favorably used, as a matter of course, random or block copolymers of α-olefins, such as ethylene, propylene, 1-butene, and 4-methyl-1-pentene. There can be, further, used cyclic olefin copolymers as disclosed in JP-A-2007-284066.

So far as the inner surface is formed by using the above-mentioned thermoplastic material, the container material 1 is not limited to the single-layer structure but may have a multilayer structure comprising a resin layer forming the inner layer and, formed thereon, other layers such as of resin, glass, paper or metal.

In the above multilayer structure, it is desired to provide an intermediate layer between the inner layer and the outer layer of the above-mentioned olefin resin, the intermediate layer being a gas barrier layer formed by using an ethylene-vinyl alcohol copolymer (saponified product of an ethylene-vinyl acetate copolymer) or an aromatic polyamide. Most desirably, the intermediate layer is a gas barrier layer of the ethylene-vinyl alcohol copolymer. By forming the gas barrier layer as the intermediate layer, the oxygen barrier property can be imparted. Specifically, the ethylene-vinyl alcohol copolymer exhibits very excellent oxygen barrier property and, therefore, effectively suppresses the oxidation or deterioration of the content caused by oxygen that has permeated through and ensures excellent content preservability.

If the above gas barrier layer is provided, it is also desired to provide an adhesive resin layer to improve adhesiveness to the inner and outer layers, and to prevent delamination. This enables the intermediate gas barrier layer to be firmly adhered and fixed to the inner and outer layers. The adhesive resins used for forming the adhesive resin layer have been known per se. For instance, there have been used resins that have a carbonyl group (>C═O) on the main chain or on the side chains in an amount of 1 to 100 meq/100 g of the resin and, specifically, 10 to 100 meq/100 g of the resin. Concretely, there are used, as adhesive resins, an olefin resin graft-modified with a carboxylic acid such as maleic acid, itaconic acid or fumaric acid or an anhydride, amide or ester thereof; an ethylene-acrylic acid copolymer; an ionically crosslinked olefin copolymer; and an ethylene-vinyl acetate copolymer.

The thickness of the container material 1 is set depending on the form of the container so as to exhibit desired strength, flexibility, capability and squeezing property. For instance, the thickness is set to be about 100 to about 800 μm in the case of a directly blow-formed plastic container that is used preferably for being filled with a viscous content.

If the multilayer structure is employed, further, the gas barrier layer (intermediate layer) may, desirably, have a thickness of, usually, 1 to 50 μm and, specifically, 9 to 40 μm while the adhesive resin layer may have such a thickness as to exhibit a suitable degree of adhesive force and, usually, a thickness of about 0.5 to about 20 μm and, preferably, about 1 to about 8 μm.

In the container material 1 having the multilayer structure, further, any one of the multiplicity of layers may be a reground resin layer formed by using a mixture of a scrap resin generated during the formation of the containers and a virgin resin used for forming the outermost layer. In this case, the amount of the scrap resin should be about 10 to about 60 parts by weight per 100 parts by weight of the virgin resin forming the outermost layer from a standpoint of reutilizing the resources yet maintaining the formability. The thickness of the layer neighboring the outermost layer may differ depending on the size of the packing container or the kind of the content, but should be such that the whole thickness of the container wall does not become unnecessarily large and that the scrap resin can be effectively utilized. That is, the thickness of the layer neighboring the outermost layer is set to be about 20 to about 400 μm.

Figure 2:
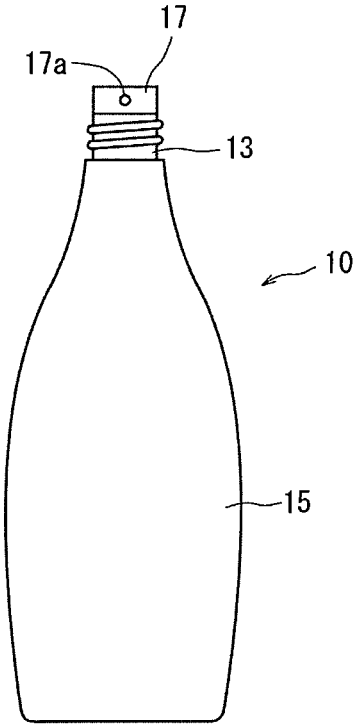
FIG. 2: a view showing the state of an empty container which is a directly blow-formed bottle representing the most preferred packing container having the cross section shown in FIG. 1.

The container used in the invention can assume the forms of pouch, bottle, cup and the like. In the invention, the liquid film 3 helps improve slipping property (slide-down property) to the liquid content. As described earlier, therefore, the directly blow-formed container that is capable of easily discharging the viscous content upon being squeezed, is suited as the container material 1. FIG. 2 shows the state of an empty container which is a directly blow-formed container for containing food right after it was formed.

The empty container generally designated at 10 has a mouth portion 13 with a screw thread at an upper portion thereof. A blow-formed portion 15 is continuous to the mouth portion 13, and includes a body portion and a bottom portion so formed as to close the body portion.

A closing portion 17 is formed at the upper part of the mouth portion 13 to close it. The closing portion 17 is forming a small hole 17*a* in which a feed pipe will be inserted to feed a fluid for blow-forming. The small hole 17*a* is communicated with the interior of the empty container 10.

That is, like in the conventional known method, a molten resin (melt of a resin for forming) is extruded (extrusion-formed) into a preform of the shape of a pipe of which the bottom portion is closed by pinch-off. Through the small hole 17*a* formed in the preform, a fluid for blow-forming is fed into the preform maintained at a predetermined temperature for blow-forming to impart the shape of a container thereto. The container is thus directly blow-formed.

If it is attempted to form a container different from the directly blow-formed container, a preform of the shape of a test tube is formed by the injection-forming, and a fluid maintained at a predetermined temperature for stretch-forming is blown therein to biaxially stretch-blow-form the preform. The preform is thus formed into the shape of a container; i.e., an empty container is obtained for being filled with a content.

<Liquid and Liquid Content>

The liquid film 3 is formed on the inner surface of the container by using a liquid which is immiscible with the fluid content filled up in the container, and works to improve slipping property (slide-down property) to the liquid content.

If the liquid is miscible with the content, then the liquid is mixed with the content and is split off the inner surface of the container. Namely, the liquid film 3 is broken down.

The liquid immiscible with the content and works to improve slipping property to the content is a liquid that is immiscible with the content or, roughly speaking, is a liquid which is oleophilic to the aqueous content or is water or a liquid which is hydrophilic to the oily content. Usually, a liquid can be used if it is capable of holding the liquid film 3 in an amount of not less than 0.1 $g/m^2$ and, specifically, not less than 0.5 $g/m^2$ in a state where the container is filled with the content. Specifically, a liquid produces a high lubricating effect if its surface tension to the inner surface of the container is greatly different from its surface tension to the content, and the liquid of this kind is suited for the present invention.

In the invention, the liquid content to be contained in the container is, preferably, a liquid content that has no shape-retaining property but has fluidity so as to utilize the slipping property of the liquid film 3 to a maximum degree. Namely, preferred examples of the liquid content are viscous paste-like or slurry liquid substances (e.g., having viscosities at 25° C. of not less than 100 mPa·s) or, concretely, ketchup, aqueous paste, honey, various sauces, mayonnaise, cosmetic liquid such as lotion, liquid detergent, shampoo, rinse, conditioner and the like. Namely, in the invention, the liquid film 3 exhibits a favorable slipping property. Therefore, even a viscous liquid material can be quickly discharged without adhering or remaining on the inner surface of the container if the container is tilted or inverted. Specifically, with the directly blow-formed container for foods described above, the content can be squeezed out by squeezing the body portion. Therefore, ketchup and mayonnaise are contained as contents.

In the invention, as concrete examples of the liquid selected depending on the kind of the content contained in the container, i.e., as the most desirable liquids for the water-containing contents (e.g., ketchup, sauce), there can be used silicone oil, glycerin fatty acid ester, liquid paraffin and edible oil and fat. Particularly preferred examples are glycerin fatty acid esters as represented by medium-chain fatty acid triglyceride, glycerin trioleate and glycerin diacetomonooleate, as well as liquid paraffin and edible oil and fat. They are difficulty volatile and have been approved as food additives and, further, have such advantages that they are odorless and do not impair the flavors of the contents.

For the oily contents, further, there can be used water or ionic liquid which is highly hydrophilic provided its boiling point lies within the above-mentioned range.

Further, for the emulsion type liquid materials, there can be favorably used, as liquids, silicone oil, glycerin fatty acid ester, liquid paraffin and edible oil and fat.

<Filling Up the Content and Forming the Liquid Film>

In the present invention, the liquid film 3 is formed on the container material 1 that has the above-mentioned form substantially simultaneously with the filling up of the liquid content. Though not limited thereto only, described below is a concrete example of the invention using a multi-pipe nozzle 20 of a structure shown in FIG. 3.

In FIG. 3, the multi-pipe nozzle 20 includes a center pipe 21 and an annular pipe 23 formed on the outer side so as to surround the center pipe 21. That is, the center pipe 21 is used for filling up the liquid content that forms the core layer while the annular pipe 23 is used for feeding the liquid that forms the outermost layer.

By using the above multi-pipe nozzle 20, the content is filled up and the liquid film 3 is formed according to a process shown in FIGS. 4A to 4C.

That is, referring to FIG. 4A, the multi-pipe nozzle 20 is inserted in an empty container 30 (e.g., the empty container 10 shown in FIG. 2 from which the closing portion 17 is cut away), and the interior of the container starts filled up with a liquid content 31 from the center pipe 21 and with a liquid 33 from the annular pipe 23. Here, the liquid 33 is fed slightly earlier than the liquid content 31. Namely, the liquid content 31 is filled up in a state where the end of the center pipe 21 of the multi-pipe nozzle 20 is covered with the liquid 33.

As shown in FIG. 4A, therefore, the liquid content 31 fills up the interior of the empty container 30 in a manner of being covered with the liquid 33.

The liquid content 31 is thus filled up. Referring next to FIG. 4B, the multi-pipe nozzle 20 is gradually pulled up so that the content 31 (and the liquid 33) filling up surrounding the multi-pipe nozzle 20 will not enter into the multi-pipe nozzle 20. After the container is filled up with the content 31 in a predetermined amount, feeding of the content 31 and feeding of the liquid 33 are discontinued, and the multi-pipe nozzle 20 is pulled out from the container 30 as shown in FIG. 4C. Operation for filling up the content 31 and the liquid 33 is now completed. Finally, the upper end of the container 30 is sealed with a lid member or the like. There is thus obtained a desired packing container filled up with the liquid content 31.

In the packing container obtained as described above, a film of the liquid 33 is necessarily formed between the content 31 and the inner surface of the container 30 as shown in FIG. 4C. The liquid film exhibits improved slipping property maintaining reliability without dispersion.

In carrying out the above operation, the rate of feeding the liquid 33 and the rate of filling up the content 31 may be so set that the thickness of the film of the liquid 33 lies in a suitable range. For instance, the rates thereof may be so set that the content 31 will not be fed at such a large rate as to break the surrounding film of the liquid 33.

As described above, it is made possible to eject a multi-layer filler comprising the core layer of the liquid content and the outermost layer of the liquid. The filling method of the present invention fills up the liquid content of which the outer circumference is at least partly covered with the liquid. In addition to the above-mentioned method, it is also allowable to eject the multilayer filler by bringing the liquid content into contact with the liquid 33 on the side (upstream) of feeding the liquid content. Moreover, the liquid content that is ejected may be coated with the liquid. Or a mist of liquid may be sprayed onto the liquid content.

In order that the film of the liquid 33 is little broken, it is desired that the liquid 33 has a viscosity smaller than a viscosity of the content 31 at a temperature at which the content 31 is filled. This is because by setting the viscosity of the liquid 33 to be smaller than the viscosity of the content 31, the liquid 33 having a small viscosity is allowed to easily follow the deformation of the content 31 despite it is filled up at a large rate and, therefore, the liquid film is effectively prevented from breaking.

It is, further, desired that a surface tension of the liquid 33 is smaller than a surface tension of the content 31. This is because by setting the surface tension of the liquid 33 to be smaller than the surface tension of the content 31, the liquid 33 is allowed to easily wet and spread on the content 31 when it is filled up. Therefore, this is also effective in preventing the film of the liquid 33 from breaking despite the content 31 is filled up at an increased rate.

According to the filling method of the present invention, as described above, the liquid content 31 is filled up and, at the same time, the film of the liquid 33 is formed preventing a decrease in the productivity caused by the operation for forming the liquid film. The thickness of the liquid film, too, can be easily adjusted by adjusting the rates of feeding the content 31 and the liquid 33.

Further, as will also be understood from FIG. 4C, a head space 40 is, usually, formed in the thus obtained packing container. In the present invention, however, when the container is in an unused and erected state, the film of the liquid 33 is selectively formed in only a region where the content 31 is present but is not formed in the head space. Therefore, the amount of the liquid 33 that is used can be minimized to effectively avoid an increase in the cost.

In the above embodiment, further, the liquid immiscible with the content was most desirably used as the liquid 33 to improve the slipping property. It is, however, also allowable to use a mixed liquid of the liquid for improving the slipping property and the liquid content. In this case, the mixed liquid is ejected from the annular pipe 23 to cover the liquid content 31 that is ejected from the center pipe 21. Here, however, the covering layer undergoes phase separation; i.e., the liquid content in the mixed liquid merges with the liquid content 31 ejected from the center pipe 21 and the liquid for improving the slipping property is repelled into the outer layer to form the liquid film.

In the foregoing was described the filling method with reference to the case of filling up the container of the shape of a bottle. So far as the multi-pipe nozzle 20 is used to fill up the content 31 and to feed the liquid 33, however, the filling method of the invention is not limited to the case of filling up the container of the bottle shape only but can, as a matter of course, be adopted to the cases of filling up the containers of any other shapes such as bags and the like, too.

DESCRIPTION OF REFERENCE NUMERAL

1: container material
3: liquid film
10: empty container
13: mouth portion
15: blow-formed portion
17: closing portion
20: multi-pipe nozzle

21: center pipe
23: annular pipe
30: empty container
31: liquid content
33: liquid

The invention claimed is:

1. A method of filling a container with a fluid content, comprising:

providing a liquid which is different from and immiscible with the fluid content, and a multi-pipe nozzle which comprises a center pipe and an annular pipe surrounding the center pipe;

inserting the multi-pipe nozzle into the container in an erected state, ejecting the fluid content from the center pipe of the multi-pipe nozzle, ejecting the liquid or a mixed liquid of the liquid and the fluid content, from the annular pipe of the multi-pipe nozzle, and forming a liquid film between an inner surface of the container and the fluid content by the liquid, the liquid having a surface tension to the inner surface of the container which is different from a surface tension of the fluid content.

2. The method of filling according to claim 1, which further comprises gradually removing the multi-pipe nozzle from the container as the amount of the fluid content filled in the container increases during at least one of ejecting the fluid content from the center pipe and ejecting the liquid or a mixed liquid and the fluid content from the annular pipe.

3. The method of filling according to claim 2, wherein the liquid or the mixed liquid is ejected before the fluid content is ejected from the center pipe.

4. A method of filling a container with a fluid content, comprising:

providing a liquid which is different from and immiscible with the fluid content, and a multi-pipe nozzle which comprises a center pipe and an annular pipe surrounding the center pipe;

inserting the multi-pipe nozzle into the container in an erected state, ejecting the fluid content from the center pipe of the multi-pipe nozzle, ejecting the liquid or a mixed liquid of the liquid and the fluid content, from the annular pipe of the multi-pipe nozzle, and forming a liquid film between an inner surface of the container and the fluid content by the liquid to improve a slipping property to a liquid content.

* * * * *